US009420379B2

(12) United States Patent
Kim et al.

(10) Patent No.: US 9,420,379 B2
(45) Date of Patent: Aug. 16, 2016

(54) PERFORMANCE ENHANCING APPARATUS OF BALANCED ARMATURE TRANSDUCER

(71) Applicant: Samsung Electronics Co., Ltd., Suwon-si, Gyeonggi-do (KR)

(72) Inventors: Taeeon Kim, Gwacheon-si (KR); Youngbae Park, Jecheon-si (KR); Byounghee Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 61 days.

(21) Appl. No.: 14/251,980

(22) Filed: Apr. 14, 2014

(65) Prior Publication Data

US 2015/0010199 A1 Jan. 8, 2015

(30) Foreign Application Priority Data

Jul. 2, 2013 (KR) ..... 10-2013-0077071

(51) Int. Cl.

| | |
|---|---|
| ***H04R 1/00*** | (2006.01) |
| ***H04R 11/02*** | (2006.01) |
| *H04R 1/10* | (2006.01) |
| *H04R 25/00* | (2006.01) |

(52) U.S. Cl.
CPC *H04R 11/02* (2013.01); *H04R 1/10* (2013.01); *H04R 25/00* (2013.01)

(58) Field of Classification Search
CPC ..... H04R 1/24; H04R 11/00; H04R 11/02; H04R 13/00; H04R 13/02; H04R 25/00
USPC ..... 381/417, 418
See application file for complete search history.

(56) References Cited

U.S. PATENT DOCUMENTS

| | | | | |
|---|---|---|---|---|
| 5,647,013 | A * | 7/1997 | Salvage | H04R 11/02 381/312 |
| 6,853,735 | B2 * | 2/2005 | Imahori | H04M 1/035 381/417 |
| 2003/0190053 | A1 * | 10/2003 | van Halteren | H04R 11/02 381/418 |
| 2013/0272564 | A1 * | 10/2013 | Miller | H04R 3/00 381/412 |

* cited by examiner

*Primary Examiner* — Brian Ensey
(74) *Attorney, Agent, or Firm* — Jefferson IP Law, LLP

(57) ABSTRACT

A balanced armature transducer is provided. The balanced armature transducer is formed with components housed within a frame and includes a pair of magnets separated by a gap to form a Direct Current (DC) magnetic field, and an armature having one end positioned between the separated magnets and having another end curved upward and fixed to an upper portion of the frame.

20 Claims, 12 Drawing Sheets

| MEASURE 10MM OF FRONT SURFACE OF DIAPHRAGM | A | B | C | D | E |
|---|---|---|---|---|---|
| SOUND PRESSURE AVERAGE OF 0.2-4KHZ | Ref | +7.6dB | +8.6dB | +5.5dB | -2.4dB |
| SOUND PRESSURE AVERAGE OF 5-16KHZ | Ref | -4.8dB | -7.6dB | -3.5dB | -2.1dB |

PERFORMANCE ENHANCING APPARATUS OF BALANCED ARMATURE TRANSDUCER

CROSS-REFERENCE TO RELATED APPLICATION(S)

This application claims the benefit under 35 U.S.C. §119 (a) of a Korean patent application filed on Jul. 2, 2013 in the Korean Intellectual Property Office and assigned Serial No. 10-2013-0077071, the entire disclosure of which is hereby incorporated by reference.

TECHNICAL FIELD

The present disclosure relates to a balanced armature transducer. More particularly, the present disclosure relates to an improved balanced armature transducer that uses little space and that can improve sound performance using limited elements.

BACKGROUND

With continuing advances in technology, electronic devices are formed having smaller sizes, such that they can be carried by a user while supporting a specific user function, and have been spotlighted in many industrial and living fields. Nowadays, electronic devices supporting various advanced user functions are available.

For example, a mobile terminal is an electronic device that has an audio reproduction function and is able to output various audio signals according to a user request. A Moving Picture Experts Group layer-3 (MP3) player, a Personal Digital Assistant (PDA), and a laptop computer are other electronic devices that are available with a sound output function of a radio receiver and an MP3 player.

An earphone is provided as a typical accessory to an electronic device having such a sound output function. Using the earphone, a user can obtain audio information through the electronic device without disturbance from external noise, such as from a surrounding environment. Further, the earphone enables the user to enjoy desired audio contents, assists the user to clearly listen and understand audio contents, and enables the user to receive clearer sound than that transferred through the air. Such an earphone can be used when studying, performing work requiring concentration, or when wishing to escape from noise in a noisy environment.

Earphones of the related art use a moving coil speaker having a frequency response curve characterized by a sound quality in which intermediate and low frequency bands are reinforced. Further, in another earphone of the related art, a balanced armature speaker characterized by a frequency response curve having a sound quality in which a high band is reinforced may be used.

FIG. 1A is a perspective view illustrating a balanced armature transducer according to the related art, and FIG. 1B is a cross-sectional view illustrating a balanced armature transducer according to the related art.

Referring to FIGS. 1A and 1B, in a balanced armature transducer 10 according to the related art, an armature 11 is formed in a C shape having an upper surface located between magnets 17 and 18, and between a coil 14, and having a lower surface 12 fixed as a bottom. Additionally, the magnets 17 and 18 are supported by a yoke 19 and the transducer 10 is partially covered by a frame 20 having a diagraph 16 disposed above. When a current is applied to the coil 14, the upper surface of the armature 11 vibrates and the vibration of the armature 11 is transferred to the diaphragm 16 through a connecting rod 15 connected to the armature 11. Accordingly, the diaphragm 16 vibrates and generates sound.

A balanced armature transducer according to the related art is formed in a C shape so as to fix the armature 11 and to fix the lower surface 12 thereof as the bottom. As such, the lower surface 12 is unrelated to the production of sound in that it is only the armature 11 that actually vibrates, while the lower surface 12 only performs a function of fixing the armature 11. However, the lower surface 12 occupies a large volume as compared with the importance of its function and thus a limitation exists in reducing an entire size and volume of the balanced armature transducer 10 and a mounting ability is thus deteriorated.

Further, in order to improve a performance of a balanced armature transducer, when a size of the magnets 17 and 18 or a size of the coil 14 is increased, a performance of the balanced armature transducer can be secured. However, a large size of the magnets 17 and 18 or of the coil 14 also causes difficulty when attempting to reduce a size and volume of the balanced armature transducer 10.

Therefore, a need exists for an improved apparatus and method for enhancing a mounting ability of the balanced armature transducer using limited space and limited elements and for improving a sound output function.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a method and apparatus for enhancing a volume of a balanced armature transducer that can support an improved sound output while maximizing space use in a structure of the balanced armature transducer.

Another aspect of the present disclosure is to provide a method and apparatus for enhancing a volume of a balanced armature transducer that can secure a sound volume feeling when listening to sound by enhancing the efficiency of sound pressure release in a low frequency band.

In accordance with an aspect of the present disclosure, a balanced armature transducer formed with components housed within a frame is provided. The balanced armature transducer includes a pair of magnets separated by a gap to form a Direct Current (DC) magnetic field, and an armature having one end positioned between the separated magnets and having another end curved upward and fixed to an upper portion of the frame.

In accordance with another aspect of the present disclosure, a balanced armature transducer formed with components housed within a frame is provided. The balanced armature transducer includes a pair of magnets separated by a gap to form a DC magnetic field, an armature having one end positioned between the separated magnets and having another end curved upward and fixed to an upper portion of the frame and in which a surface opposite to the magnet is formed in an uneven structure, a coil wound around a portion of the armature the coil configured to create an Alternating Current (AC) magnetic field between the armature and the magnets by generating a magnetic flux to the armature when a signal current is applied, a diaphragm configured to radiate sound, and a connecting rod connected between the armature and the diaphragm, wherein the diaphragm is further configured to vibrate in correlation with displacement of the connecting rod, the connecting rod being displaced as the armature is deformed when the AC magnetic field is overlapped with the DC magnetic field.

In accordance with another aspect of the present disclosure, a balanced armature transducer is provided. The balanced armature transducer includes a frame, a pair of magnets separated by a gap to form a Direct Current (DC) magnetic field, and an armature having a first end positioned between the separated magnets, the first end including a first surface and a second surface opposite the first surface, each of the first surface and the second surface having a length dimension and a width dimension, wherein at least one of the first surface and the second surface has an increased surface area as compared with a plane surface of the same dimensions.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

The same reference numerals are used to represent the same elements throughout the drawings.

DETAILED DESCRIPTION

Figure 1A:
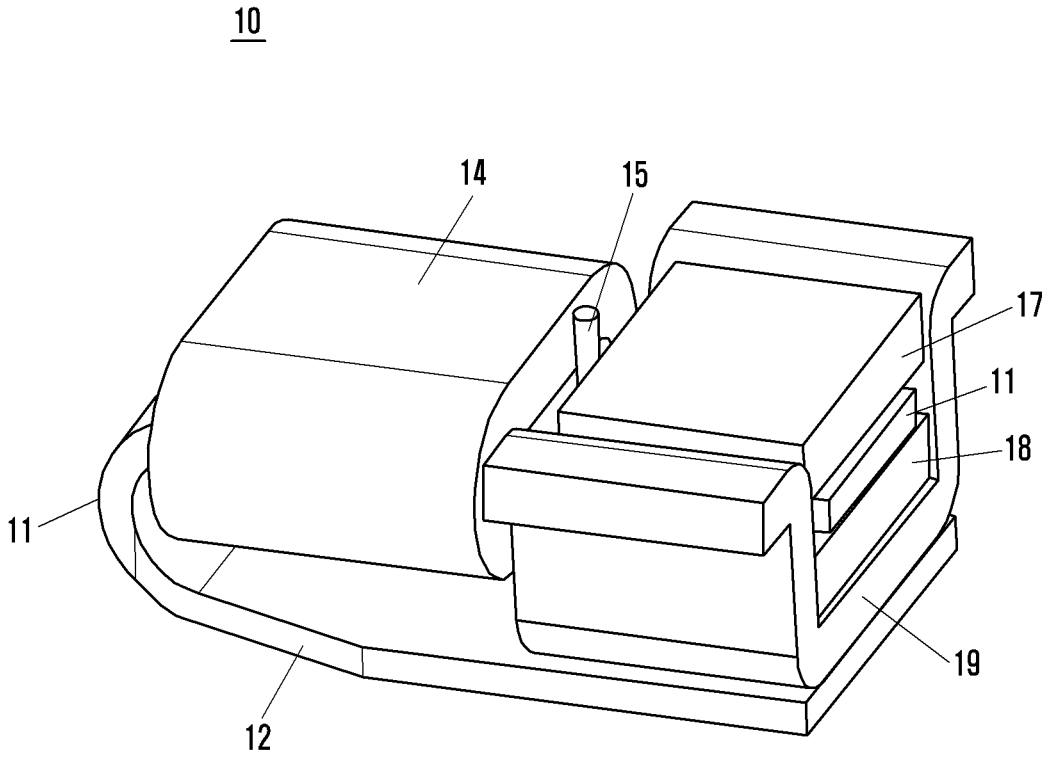
FIG. 1A (RELATED ART)
FIG. 1A is a perspective view illustrating a balanced armature transducer according to the related art.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

A balanced armature transducer is used for an audio device such as a miniature speaker adapted for use as a hearing aid or an earphone. In operation, the earphone or the hearing aid transfers sound by increasing a sound pressure at the inside of the ear. When warn by a user, an open type earphone does not entirely contact with the user's ear, such that the space within the ear is open to the outside. Thus, the sound pressure within the ear is easily diminished and a low frequency characteristic is deteriorated. On the other hand, a closed type earphone has close contact with the inside of the user's ear, such that it is much more difficult for an external sound to be heard by the user. Thus, the closed type earphone has merit in that it is better at preventing external interference. Furthermore, the sound pressure is more easily maintained such that the closed type earphone has an excellent characteristic in a low frequency band.

Such an earphone is formed with a plurality of constituent elements that each has a sensitive influence on sound transfer. Further, while it may be desired to increase the size of a particular constituent element to improve its performance, the size of each constituent element is limited due to the small size of the inside of an ear.

A balanced armature transducer according to an embodiment of the present disclosure enlarges a surface area having an influence on a magnetic force of a magnet by forming a cross-section of an armature opposite to the magnet to have an uneven structure and thus enhances a displacement of an armature rod without increasing a size of the armature, thereby enhancing efficiency of sound pressure release. Accordingly, by securing a sound volume feeling when listening to sound in a low sound band, a performance of the balanced armature transducer can be enhanced.

Further, a balanced armature transducer according to an embodiment of the present disclosure omits a structure disposed only to fix an armature regardless of emission of a sound pressure and has an armature structure modified not to increase a volume of the balanced armature transducer and thus can enhance space efficiency while stably fixing the armature.

Hereinafter, a structure of a balanced armature transducer according to an embodiment of the present disclosure is described with reference to FIGS. 2 to 6.

Figure 2:
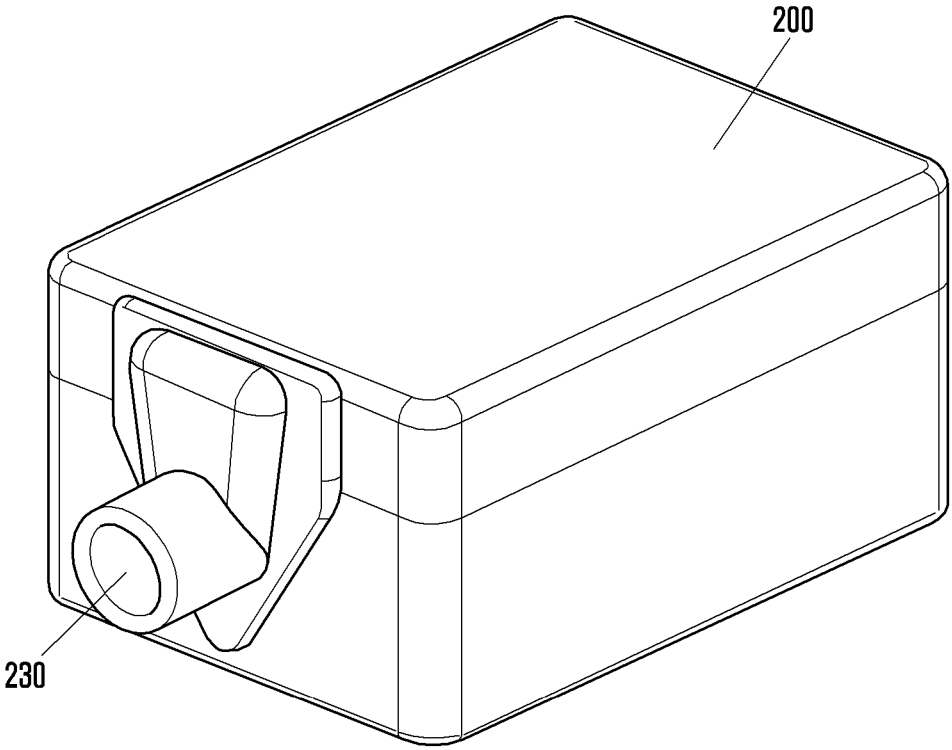
FIG. 2 is a perspective view illustrating an external appearance of a balanced armature transducer according to an embodiment of the present disclosure.
Figure 3A:
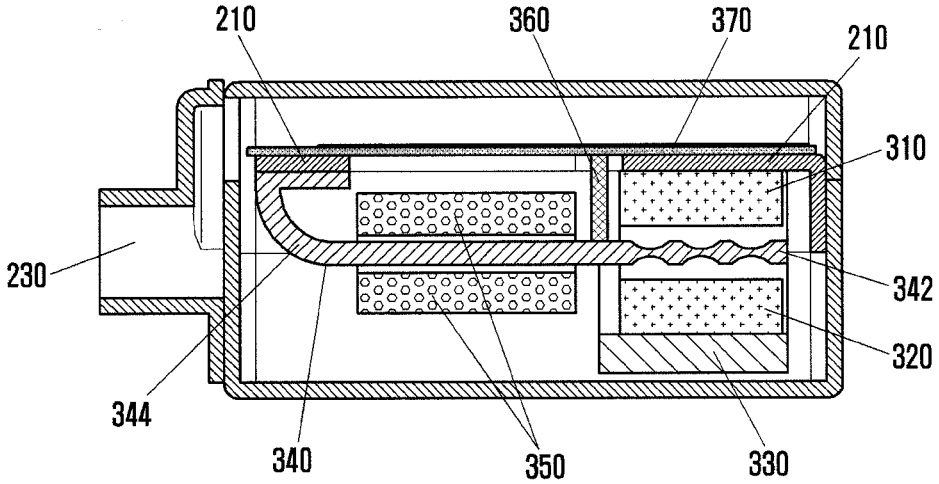
FIGS. 3A, 3B, and 3C are cross-sectional views illustrating a balanced armature transducer, such as the balanced armature transducer of FIG. 2, according to an embodiment of the present disclosure.
Figure 3B:
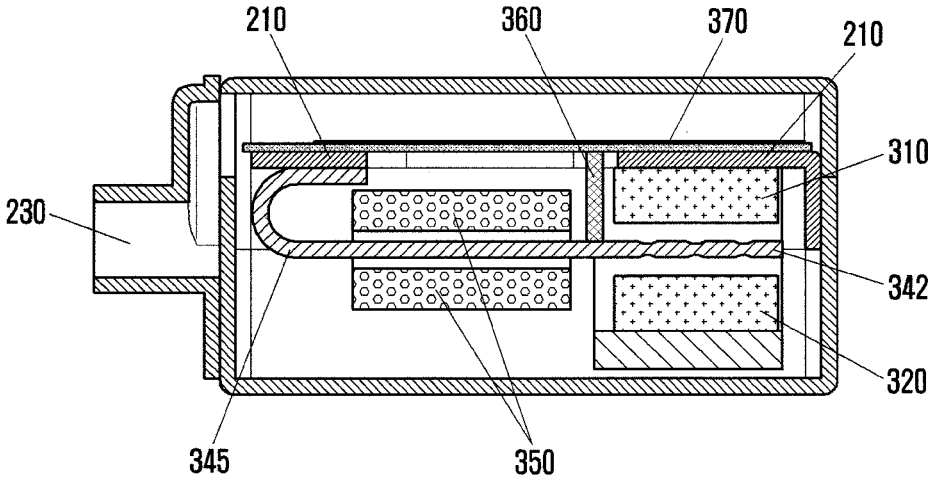
Figure 3C:
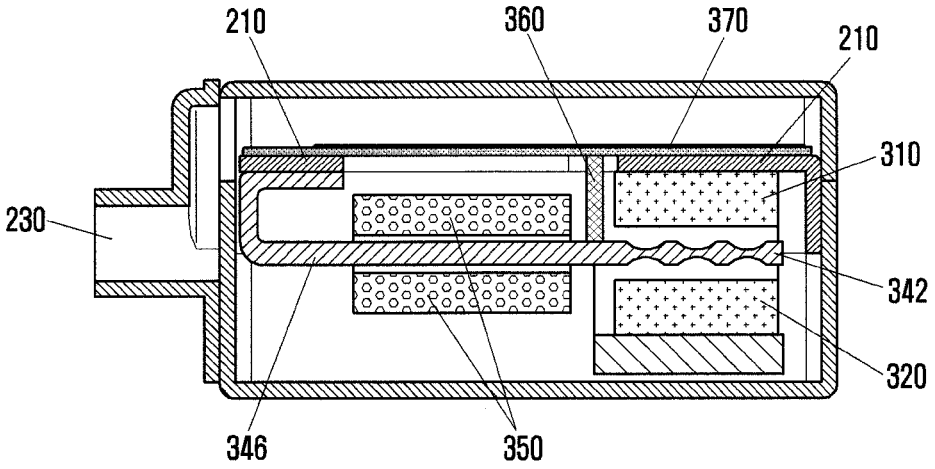
Figure 4:
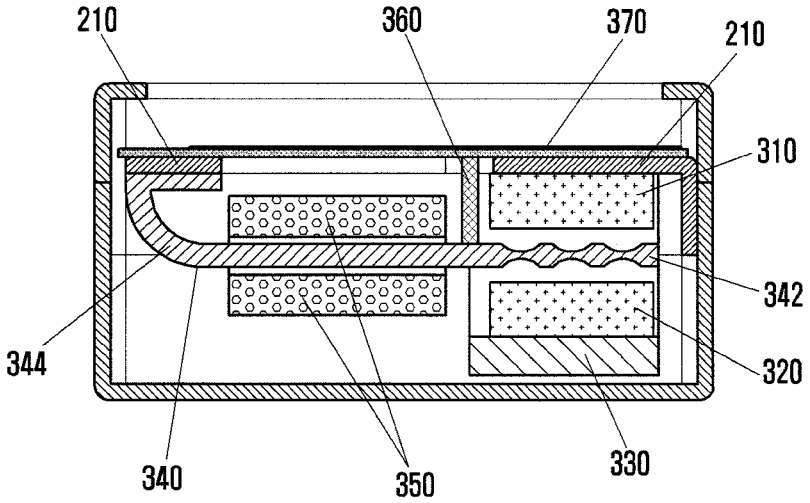
FIG. 4 is a cross-sectional view illustrating a balanced armature transducer according to another embodiment of the present disclosure.
Figure 5:
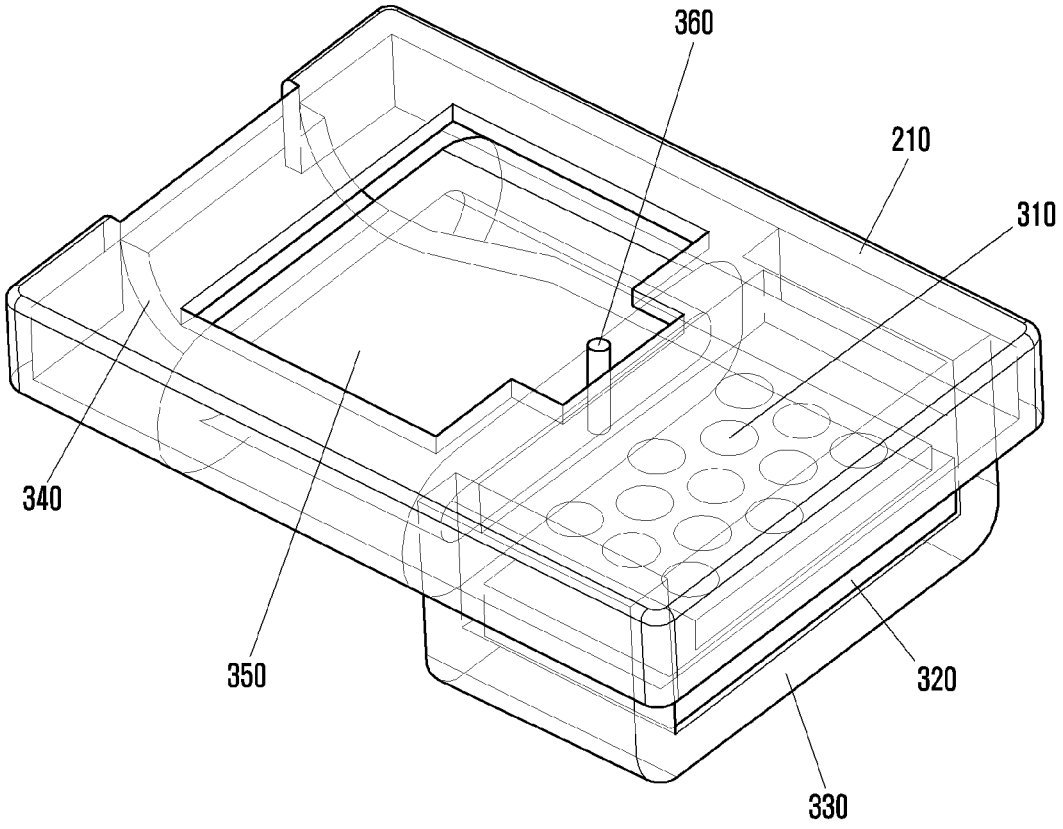
FIG. 5 is a perspective view illustrating a balanced armature transducer, such as the balanced armature transducer of FIG. 2, according to an embodiment of the present disclosure.
Figure 6:
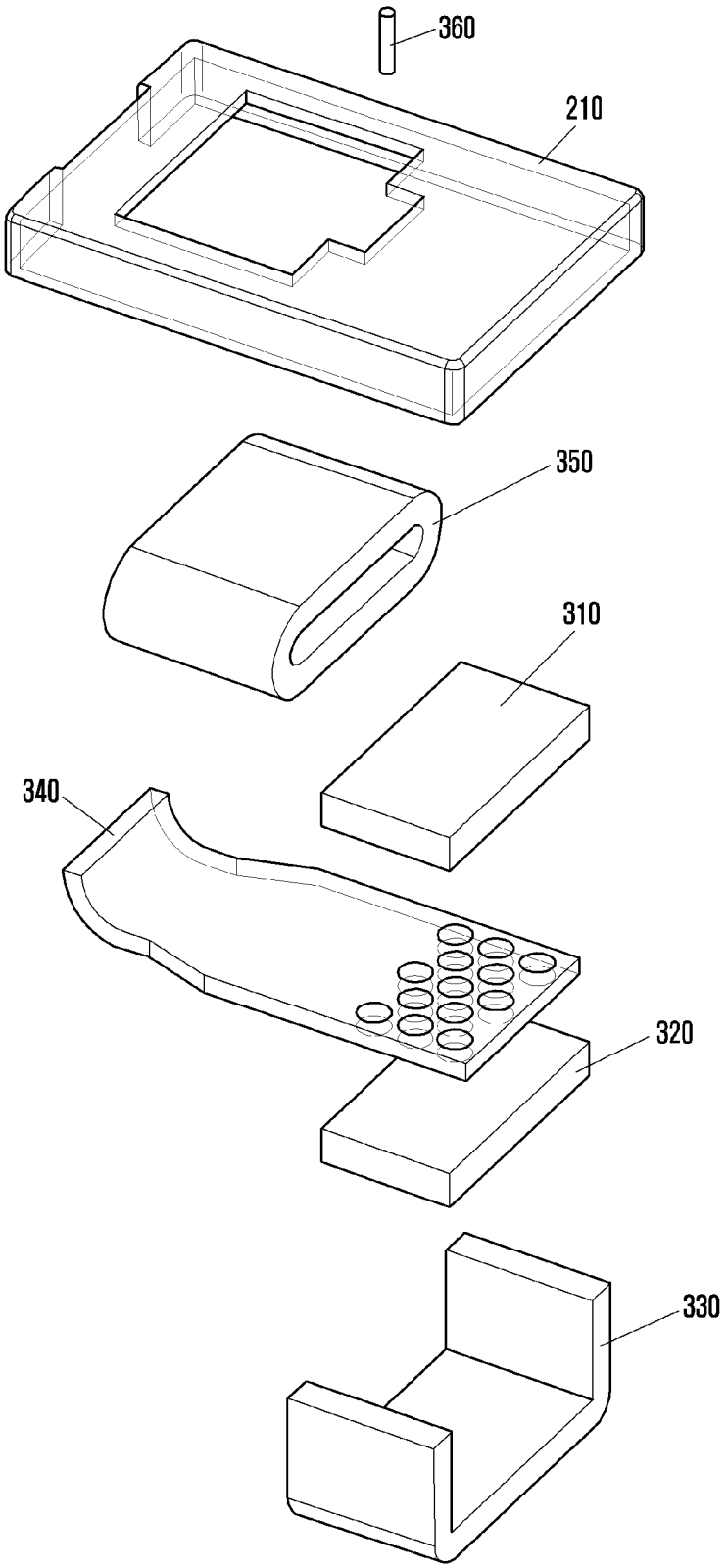
FIG. 6 is an exploded perspective view illustrating a balanced armature transducer, such as the balanced armature transducer of FIG. 2, according to an embodiment of the present disclosure.

FIG. 2 is a perspective view illustrating an external appearance of a balanced armature transducer according to an embodiment of the present disclosure, FIGS. 3A to 3C are cross-sectional views illustrating a balanced armature transducer, such as the balanced armature transducer of FIG. 2, according to an embodiment of the present disclosure, FIG. 4 is a cross-sectional view illustrating a balanced armature transducer according to another embodiment of the present disclosure, FIG. 5 is a perspective view illustrating a balanced armature transducer, such as the balanced armature transducer of FIG. 2, according to an embodiment of the present disclosure, and FIG. 6 is an exploded perspective view illustrating a balanced armature transducer, such as the balanced armature transducer of FIG. 2, according to an embodiment of the present disclosure.

Referring to FIGS. 2 to 6, a balanced armature transducer 200 receives a sound signal through a sound signal line (not shown) connected from the outside and outputs sound to a radiation port 230. The balanced armature transducer 200 may be formed in a closed type frame that exposes the radiation port 230.

As shown in FIGS. 3A to 3C and 4, the radiation port 230 may be formed having a structure that externally protrudes from one side surface of a closed type frame, a structure in which one side surface (e.g., an upper side surface) of a closed type frame is open, or a structure in which one side surface and an upper side surface of a circumference of a closed type frame are open, as shown in FIG. 4. That is, a structure of the radiation port 230 may have any of various forms and those shown in the accompanying drawings are merely for example and not to be construed as limiting.

Referring to the cross-sectional view of a balanced armature transducer of FIG. 3A, the balanced armature transducer 200 according to an embodiment of the present disclosure may include a frame 210, a pair of magnets 310 and 320, a yoke plate 330, an armature 340, a coil 350, a connecting rod 360, and a diaphragm 370.

The frame 210 performs a function of supporting the diaphragm 370. In an embodiment, the frame 210 is formed with an internal frame and an external frame, and may have an external shape of a cuboid. Of course, a structure of the frame 210 is not limited thereto but may be any of various shapes. Also, the frame 210 may be made of a hard material such as aluminum or a hard resin.

The pair of magnets 310 and 320 are separated by a gap to form a Direct Current (DC) magnetic field. The pair of magnets 310 and 320 may be considered as, for example, an upper magnet 310 and a lower magnet 320, a top magnet 310 and a bottom magnet 320, or simply a first magnet 310 and a second magnet 320.

In a lower end portion of the lower magnet 320, the yoke plate 330 is provided. The yoke plate 330 may be provided to form a closed circuit including the magnets 310 and 320. That is, within an air gap, a substantially constant static magnetic field occurs from the upper magnet 310 and the lower magnet 320. A return path of such a static magnetic field is limited by the yoke plate 330. The yoke plate 330 may be made of a material having a high magnetic permeability and thus having a high magnetic property.

One end 342 of the armature 340 is positioned between the pair of magnets 310 and 320 that are separated by a gap. The other end 344, which is located in an opposite direction from the one end 342, has a bent or curved form in that it is formed to bend or curve upward to be fixed to an upper portion of the frame 210. A bending structure of the other end 344 may have a hook form as shown in FIG. 3A, a U-shaped streamline shape 345 in which a bent portion is laid to the side as shown in FIG. 3B, or a shape in which a bent portion is formed in a ⊏ -shaped form 346 as shown in FIG. 3C. Of course, it is to be understood that the other end 344 may adapt any structure that can be fixed to an upper portion of the frame 210.

As explained above, an armature of the related art is formed having a C type in order to fix the armature. However, when formed having a C type, the armature not only occupies an additional volume, the additional volume is unnecessary as it does not assist in a function of emitting a sound pressure. On the other hand, a balanced armature transducer according to an embodiment of the present disclosure forms one end 342 having a bent or curved structure and fixes the one end 342 to the frame 210, thereby lowering an overall height of the balanced armature transducer. Accordingly, in the present disclosure, while stably fixing an armature, the space occupied by the armature can be effectively reduced.

The armature 340 may be formed using any of various methods. For example, the armature 340 may be formed by stamping out a metal strip. In that case, one end of the metal stamp may be easily bent. The armature 340 may be formed to include a known magnetic material such as a permalloy (or iron-nickel magnetic alloy) and an iron-silicone material such as a silicon steel or other materials. Also, the armature 340 may be made of a material having a high magnetic permeability and thus having a high magnetic property.

The armature 340 is positioned between the pair of separated magnets 310 and 320 may include an air gap between itself and either or both of the magnets 310 and 320.

The coil 350 is wound at a circumference of a portion of the armature 340. With this arrangement, when a driving signal such as a current signal is applied, the coil 350 generates a magnetic flux to the armature 340 to enable an Alternating Current (AC) magnetic field to be formed between the armature 340 and the magnets 310 and 320.

More specifically, when a driving signal is not applied to the coil 350, the armature 340 is positioned at an intermediate location in the air gap between the upper magnet 310 and the lower magnet 320, and a magnetic force operating from the magnets 310 and 320 on the armature 340 is balanced. That is, the one end 342 of the armature 340 is formed to freely move under a magnetic force, and in a state in which a driving signal is not applied through the coil 350, the one end 342 is positioned at a substantially equal distance from the upper magnet 310 and the lower magnet 320.

The driving signal is a signal current applied to the coil 350 and may be applied to the coil 350 wound at a circumference of a portion of the armature 340. The driving signal increases an attractive force between the armature 340 and one of the magnets 310 and 320, depending on the polarity of the driving signal, thereby enabling the armature 340 to displace toward a corresponding magnet. Here, the armature 340 has sufficient rigidity such that, even as the armature 340 is so biased toward the magnet, the armature 340 is not stuck to the magnet.

More particularly, in the armature 340 according to an embodiment of the present disclosure, a surface area of the one end 342, located between the magnets 310 and 320, is formed having a structure that is greater than that of a flat plane.

More specifically, a surface of the one end 342, located between the magnets 310 and 320, is formed having an uneven structure and thus a surface area that is affected by the magnetic force of the magnets 310 and 320 may be enlarged. The uneven structure may be formed having a surface area wider than that of a flat surface in at least one form of a sine wave, quadrangle, polygon, and hemisphere.

As a surface area of the armature 342 located between the magnets 310 and 320 is enlarged, an attractive force generated in the armature 340 increases. Therefore, a displacement of the connecting rod 360 connected to the armature 340 increases which causes an increase in the vibration of the diaphragm 370 and enhances the sound quality.

That is, in the present disclosure, by forming an uneven structure at one end 342 of an armature located between the magnets 310 and 320 so that the magnetic force has a greater influence on the armature 340, a sound performance can be enhanced without an increase in the size of a component.

The diaphragm 370 may be fixedly attached or otherwise coupled to the frame 210 and may be physically connected to the armature 340 through the connecting rod 360. The connecting rod 360 may be made of a non-magnetic material having rigidity.

When a signal current is applied to the coil 350, an AC magnetic field formed between the armature 340 and the magnets 310 and 320 is overlapped with a DC magnetic field formed between the magnets 310 and 320 by a magnetic flux generating in the armature 340. In this case, the armature 340 is deformed in a vertical direction. Accordingly, the connecting rod 360 connected to the armature 340 displaces in a vertical direction. As a displacement of the connecting rod 360 is transferred to the diaphragm 370, connected and fixed to an upper end portion thereof, the diaphragm 370 vibrates, and thus sound may occur. Sound generated in this way is emitted to the outside of the balanced armature transducer through the radiation port 230 and is thus finally transferred to the user's ear.

Figure 1B:
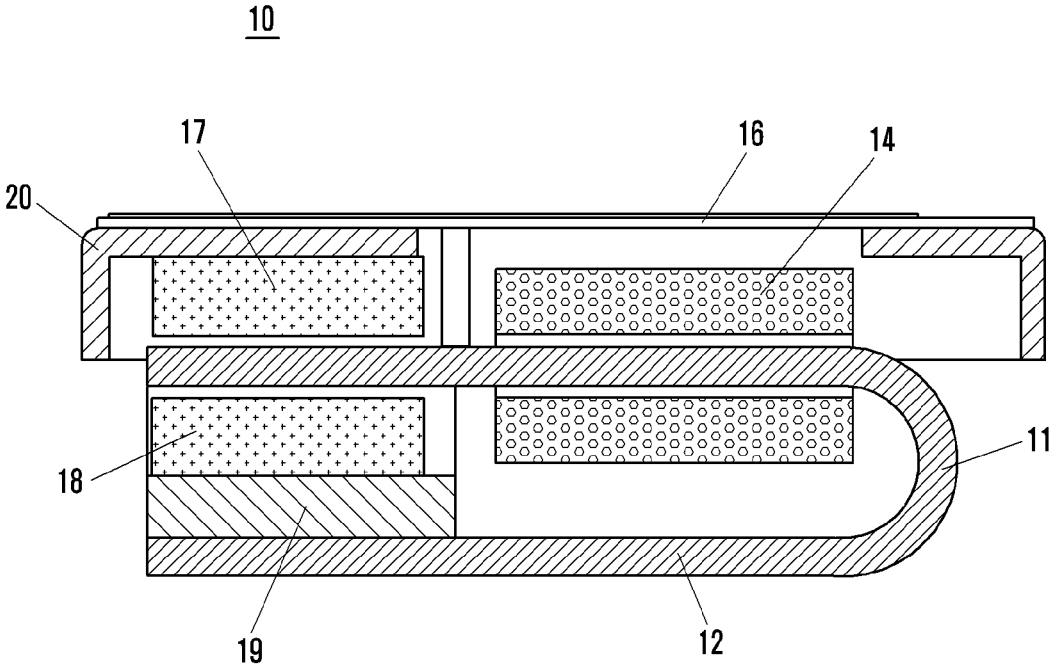
FIG. 1B (RELATED ART)
FIG. 1B is a cross-sectional view illustrating a balanced armature transducer according to the related art.

Under substantially the same conditions, a performance of components of embodiments of the present disclosure were compared with that of the related art shown in FIGS. 1A and 1B. Two cases of a balanced armature transducer having one end 342 as an uneven portion of the armature 340 and the other end 344 as a fixing portion were analyzed. The results showed an improvement of 7.6 dB in the 200 Hz-4 kHz frequency band and a decrease of 4.8 dB in the 4 kHz-20 kHz frequency band. Accordingly, sound output by a balanced armature transducer of the present disclosure is advantageous in securing a performance of a low frequency band because a first resonant point F0 is lower than that of the related art.

It is also observed that, as a width of the armature 340 is reduced, the first resonant point F0 moves upward and thus a sound performance is changed. Thereby, a width of the armature 340 can be adjusted according to a desired sound pressure sensitivity. Therefore, by adjusting a width of the armature 340, a balanced armature transducer having a desired performance can be produced.

Figure 7A:
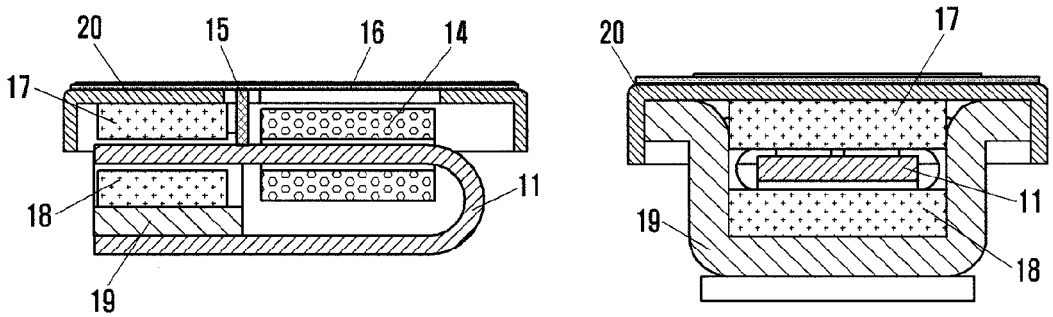
FIG. 7A (RELATED ART)
FIGS. 7A, 7B, 7C, 7D, and 7E are cross-sectional views and partial side cross-sectional views illustrating balanced armature transducers of various forms according to the related art and according to an embodiment of the present disclosure.
Figure 7B:
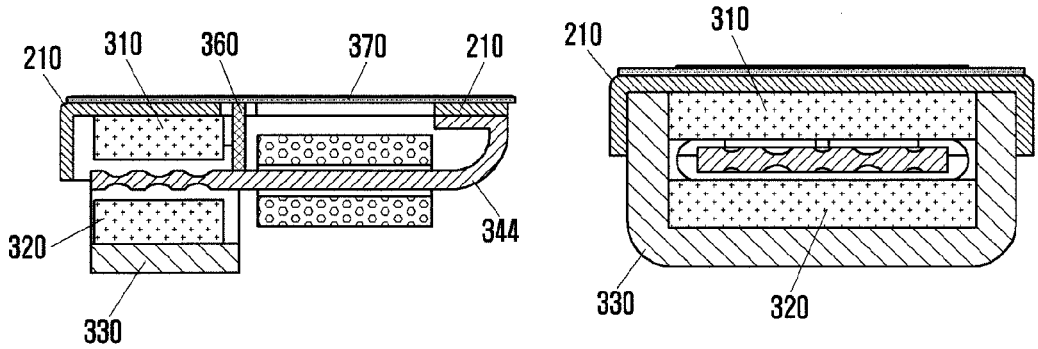
Figure 7C:
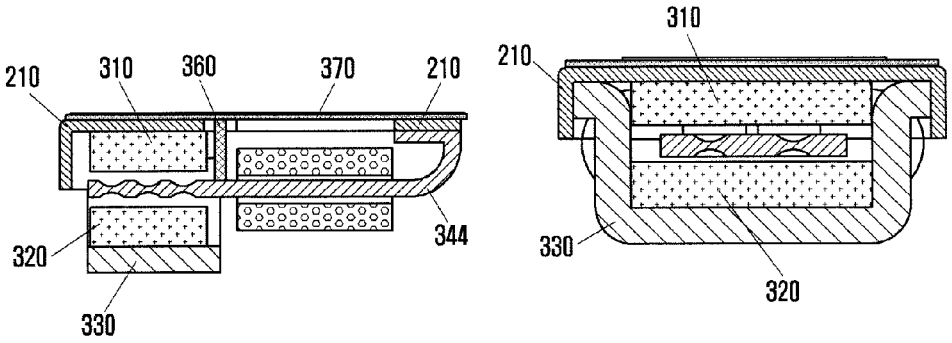
Figure 7D:
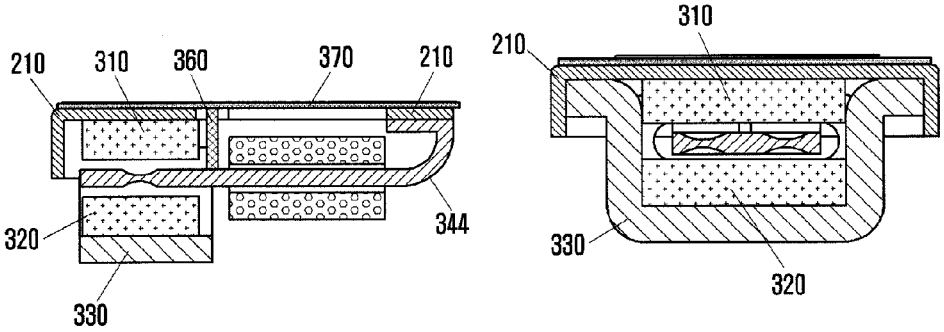
Figure 7E:
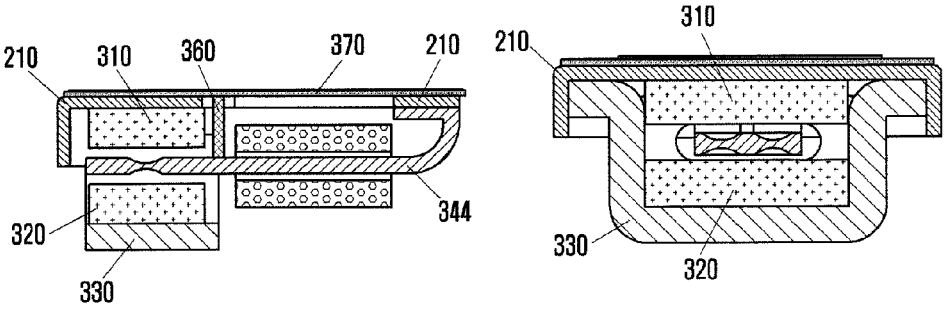
Figure 8:
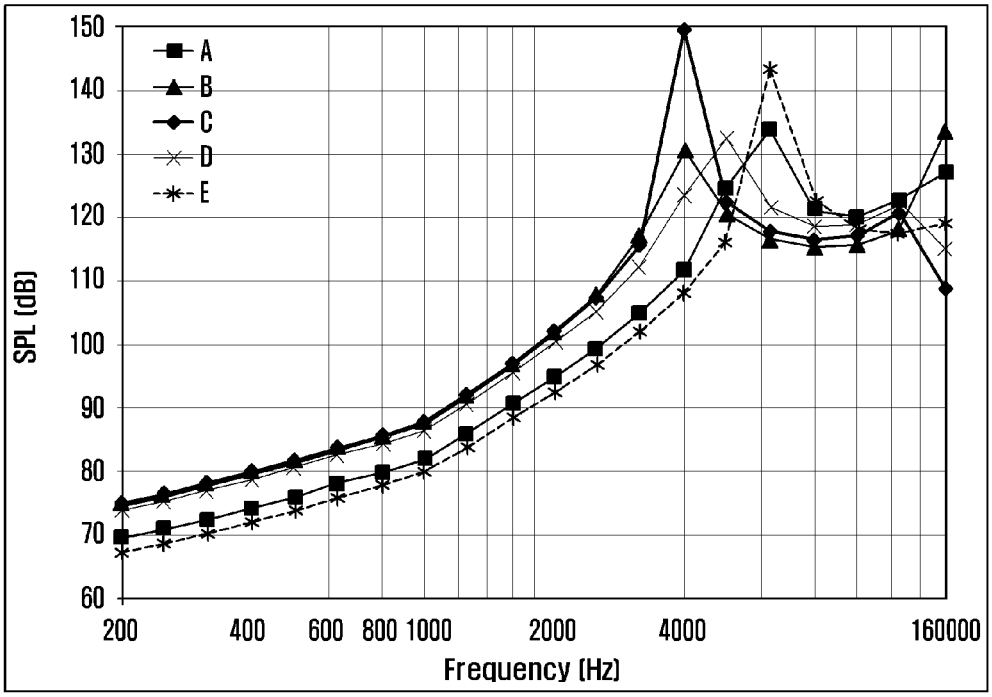
FIG. 8 illustrates a graph representing a frequency characteristic of sound radiated by each balanced armature transducer of FIGS. 7A to 7E and a table of a sound pressure average according to an embodiment of the present disclosure.

FIGS. 7A to 7E are cross-sectional views and partial side cross-sectional views illustrating balanced armature transducers of various forms according to the related art and to an embodiment of the present disclosure, and FIG. 8 illustrates a graph representing a frequency characteristic of sound radiated by each balanced armature transducer of FIGS. 7A to 7E and a table of a sound pressure average according to an embodiment of the present disclosure.

Referring to FIGS. 7A to 7E, FIG. 7A illustrates a cross-section and a partial side cross-section of a balanced armature transducer of the related art as shown above with reference to FIGS. 1A and 1B, and FIGS. 7B to 7E illustrate cross-sections and partial side cross-sections of balanced armature transducers according to embodiments of the present disclosure. The width of armature 340 narrows as the drawings advance from FIG. 7B to FIG. 7E. Also, FIG. 7B illustrates a yoke plate 330 having substantially flat sides as the yoke plate 330 approaches the frame 210, while FIGS. 7C to 7E illustrate a yoke plate 330 having sides that bend or flare out as the yoke plate approaches the frame 210. These different configurations of the yoke plate 330 are provided as examples only and should not be construed as limiting. For example, the configuration of the yoke plate 330 may be altered to accommodate a manufacturing scheme. Moreover, simply because an armature 340 having one end 342 with a certain width or configuration is illustrated in conjunction with a certain yoke plate 330, it should be understood that this is simply for illustration and should not be construed as limiting the various configurations and combinations of yoke plates 330 and armatures 340.

Referring to FIGS. 7A to 7E, and 8, as a width of the armature 340 reduces, it can be seen that a first resonant point F0 moves upward. Therefore, as a width of the armature 340 is increase, sound pressure sensitivity of a low frequency band may increase. In this way, a balanced armature transducer according to an embodiment of the present disclosure can adjust sound pressure sensitivity of a low frequency band by simply adjusting a width of an armature without using an electric circuit.

Further, it can be seen that a sound pressure of sound emitted by a balanced armature transducer according to an embodiment of the present disclosure increased as compared with that of sound emitted by the balanced armature transducer of the related art.

An embodiment of the present disclosure provides an improved balanced armature transducer such as a speaker and a microphone to use for a hearing aid, a speaker wearing in an ear, an earphone, a bone-conduction audio device, a cellular phone, other different phones, an earpiece, a radio receiver, a portable music player, and other entertainment devices.

As described above, in a volume enhancing apparatus of a balanced armature transducer according to the present disclosure, by fixing an armature to a frame by changing a structure of the armature, while the armature is stably fixed, the space occupied by components can be effectively reduced.

Further, by forming a cross-section of an armature located between a pair of magnets to have an uneven structure, a surface area affected by a magnetic force of the magnets is enlarged and a displacement of an armature rod increases such that an efficiency of sound pressure release can be enhanced. More particularly, by enhancing the efficiency of sound pressure release in a low frequency sound band, when listening to sound, a volume feeling can be secured.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A balanced armature transducer formed with components housed within a frame, the balanced armature transducer comprising:

a diaphragm configured to radiate sound;

a pair of magnets separated by a gap to form a Direct Current (DC) magnetic field; and an armature having one end positioned between the separated magnets and having another end curved upward and fixed to an inner surface of an upper portion of the frame, wherein the diaphragm is disposed above the upper portion of the frame which fixes the armature.

2. The balanced armature transducer of claim 1, further comprising:

a coil wound around a portion of the armature, the coil configured to create an Alternating Current (AC) magnetic field between the armature and the magnets by generating a magnetic flux to the armature when a signal current is applied;

and a connecting rod connected between the armature and the diaphragm, wherein the diaphragm is further configured to vibrate in correlation with displacement of the connecting rod, the connecting rod being displaced as the armature is deformed when the AC magnetic field is overlapped with the DC magnetic field.

3. The balanced armature transducer of claim 1, wherein the other end of the armature that is fixed to the upper portion of the frame has a sectional shape of at least one of an U shape declined to the side, a '⊏' shape, and a hook shape.

4. The balanced armature transducer of claim 1, wherein the armature is formed in an uneven structure in which a surface having an influence on a magnetic force by the magnet has a surface area greater than a plane.

5. The balanced armature transducer of claim 4, wherein the uneven structure of the armature is at least one of a sine wave, a quadrangle, a polygon, and a hemisphere shape.

6. The balanced armature transducer of claim 1, wherein a width of the armature is adjusted according to a desired sound pressure sensitivity.

7. The balanced armature transducer of claim 2, further comprising at least one radiating port that externally radiates sound generated by the diaphragm.

8. The balanced armature transducer of claim 7, wherein the radiating port externally protrudes from one side surface of a circumference of the frame to radiate sound in a direction different from a direction in which the diaphragm vibrates.

9. The balanced armature transducer of claim 7, wherein the radiating port radiates sound in a direction in which the diaphragm vibrates, as an upper side surface of the frame has a shape open to the outside.

10. The balanced armature transducer of claim 7, wherein the radiating port radiates sound in a direction in which the diaphragm vibrates and a direction different from the direction to one side of a circumference of the frame and an upper side surface of the frame.

11. A balanced armature transducer formed with components housed within a frame, the balanced armature transducer comprising:

a pair of magnets separated by a gap to form a Direct Current (DC) magnetic field;

an armature having one end positioned between the separated magnets and having another end curved upward and fixed to an inner surface of an upper portion of the frame and in which at least one surface of the one end of the armature positioned between the magnets is formed having an uneven structure;

a coil wound around a portion of the armature, the coil configured to create an Alternating Current (AC) magnetic field between the armature and the magnets by generating a magnetic flux to the armature when a signal current is applied;

a diaphragm configured to radiate sound; and a connecting rod connected between the armature and the diaphragm, wherein the diaphragm is further configured to vibrate in correlation with displacement of the connecting rod, the connecting rod being displaced as the armature is deformed when the AC magnetic field is overlapped with the DC magnetic field, and wherein the diaphragm disposed above the upper portion of the frame which fixes the armature.

12. A balanced armature transducer comprising:

a frame;

a diaphragm configured to radiate sound;

a pair of magnets separated by a gap to form a Direct Current (DC) magnetic field; and an armature having a first end positioned between the separated magnets, the first end including a first surface and a second surface opposite the first surface, each of the first surface and the second surface having a length dimension and a varying width dimension, wherein at least one of the first surface and the second surface has an increased surface area as compared with a plane surface of the same dimensions, and wherein the diaphragm is disposed above an upper portion of the frame which fixes the armature.

13. The balanced armature transducer of claim 12, further comprising:

a coil wound around a portion of the armature, the coil configured to create an Alternating Current (AC) magnetic field between the armature and the magnets by generating a magnetic flux to the armature when a signal current is applied;

a diaphragm configured to radiate sound; and a connecting rod connected between the armature and the diaphragm, wherein the diaphragm is further configured to vibrate in correlation with displacement of the connecting rod, the connecting rod being displaced as the armature is deformed when the AC magnetic field is overlapped with the DC magnetic field, and wherein the diaphragm is disposed above an upper portion of the frame which fixes the armature.

14. The balanced armature transducer of claim 12, wherein a second end of the armature is fixed to a portion of the frame and has a sectional shape of at least one of an U shape declined to the side, a '⊏' shape, and a hook shape.

15. The balanced armature transducer of claim 12, wherein the at least one of the first surface and the second surface of the first end of the armature has a shape of at least one of a sine wave, a quadrangle, a polygon, and a hemisphere.

16. The balanced armature transducer of claim 12, wherein at least one of the width of the first surface of the first end of the armature and the width of the second surface of the first end of the armature is adjusted according to a desired sound pressure sensitivity.

17. The balanced armature transducer of claim 13, further comprising at least one radiating port that externally radiates sound generated by the diaphragm.

18. The balanced armature transducer of claim 17, wherein the radiating port externally protrudes from one side surface of a circumference of the frame to radiate sound in a direction different from a direction in which the diaphragm vibrates.

19. The balanced armature transducer of claim 17, wherein the radiating port radiates sound in a direction in which the diaphragm vibrates, as an upper side surface of the frame has a shape open to the outside.

20. The balanced armature transducer of claim 17, wherein the radiating port radiates sound in a direction in which the diaphragm vibrates and a direction different from the direction to one side of a circumference of the frame and an upper side surface of the frame.

* * * * *